US009752362B2

(12) United States Patent
Nakayama et al.

(10) Patent No.: US 9,752,362 B2
(45) Date of Patent: Sep. 5, 2017

(54) HOOD HINGE STRUCTURE

(71) Applicant: TOYOTA JIDOSHA KABUSHIKI KAISHA, Toyota-shi, Aichi-ken (JP)

(72) Inventors: Shuichiro Nakayama, Okazaki (JP); Ozge Yildirim Caliskan, Zaventem (BE)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/112,951

(22) PCT Filed: Jan. 26, 2015

(86) PCT No.: PCT/IB2015/000065
§ 371 (c)(1),
(2) Date: Jul. 20, 2016

(87) PCT Pub. No.: WO2015/114439
PCT Pub. Date: Aug. 6, 2015

(65) Prior Publication Data

US 2016/0340950 A1 Nov. 24, 2016

(30) Foreign Application Priority Data

Jan. 29, 2014 (JP) ..... 2014-014675

(51) Int. Cl.
*E05D 5/00* (2006.01)
*E05D 5/02* (2006.01)
(Continued)

(52) U.S. Cl.
CPC ..... *E05D 11/10* (2013.01); *E05D 5/062* (2013.01); *E05D 9/00* (2013.01); *E05D 2011/009* (2013.01); *E05Y 2900/536* (2013.01)

(58) Field of Classification Search
CPC ..... Y10T 16/372; Y10T 16/387; Y10T 29/24; E05D 11/10; E05D 5/043; E05D 5/06;
(Continued)

(56) References Cited

U.S. PATENT DOCUMENTS 1,598,163 A * 8/1926 Soss ..... E05D 3/02 16/270
3,663,987 A * 5/1972 Hawkins ..... E05D 5/06 16/387
(Continued)

FOREIGN PATENT DOCUMENTS

GB 2055954 A * 3/1981 ..... E05D 11/1071
GB 2082671 A * 3/1982 ..... B21D 53/40
(Continued)

OTHER PUBLICATIONS

Partial Translation of Nov. 17, 2015 Office Action issued in Japanese Patent Application No. 2014-014675.
(Continued)

*Primary Examiner* — Chuck Mah
(74) *Attorney, Agent, or Firm* — Oliff PLC

(57) ABSTRACT

A hood hinge structure includes a hood hinge base (12) and a hood hinge arm (14). The hood hinge base is fixed to a vehicle body. The hood hinge arm includes a supported portion (22) and a fixed portion (24). The supported portion is provided at a base end side of the hood hinge arm and is supported by the hood hinge base. The fixed portion (24) is provided at a tip end side of the hood hinge arm and is fixed to a hood. At least a portion of the hood hinge arm from the supported portion to the fixed portion has a laminated structure.

7 Claims, 6 Drawing Sheets

(51) Int. Cl.

| | |
|---|---|
| ***E05D 11/10*** | (2006.01) |
| ***E05D 5/06*** | (2006.01) |
| ***E05D 9/00*** | (2006.01) |
| *E05D 11/00* | (2006.01) |

(58) Field of Classification Search
CPC ..... E05D 5/062; E05D 2005/067; E05D 9/00; E05D 2011/009; E05Y 2900/536; E05Y 2900/248
See application file for complete search history.

(56) References Cited

U.S. PATENT DOCUMENTS

| | | | | | |
|---|---|---|---|---|---|
| 4,097,958 | A * | 7/1978 | Van Dell | E05F 1/1238 | 16/225 |
| 4,223,420 | A * | 9/1980 | Yukimoto | E05D 3/145 | 16/288 |
| 5,404,618 | A * | 4/1995 | Heiler | E05D 7/121 | 16/261 |
| 5,444,894 | A * | 8/1995 | Heiler | E05D 7/121 | 16/257 |
| 5,611,114 | A * | 3/1997 | Wood, Jr. | E05D 3/127 | 16/366 |
| 5,632,065 | A * | 5/1997 | Siladke | B60J 5/0479 | 16/335 |
| 7,093,877 | B2 * | 8/2006 | Duffy | E05D 3/16 | 296/76 |
| 7,195,307 | B2 * | 3/2007 | Tucker | B62D 25/10 | 16/225 |
| 2003/0159247 | A1 * | 8/2003 | Schott | E05D 5/062 | 16/244 |
| 2004/0055112 | A1 * | 3/2004 | Kiefer | E05D 5/062 | 16/302 |
| 2004/0111833 | A1 * | 6/2004 | Janczak | E05D 5/0207 | 16/221 |
| 2005/0210630 | A1 * | 9/2005 | Lowen | E05D 5/062 | 16/379 |
| 2010/0101048 | A1 * | 4/2010 | Thomas | B60R 21/34 | 16/223 |
| 2014/0298617 | A1 * | 10/2014 | Krajenke | E05D 5/062 | 16/277 |

FOREIGN PATENT DOCUMENTS

| | | | |
|---|---|---|---|
| GB | 2480362 | A | 11/2011 |
| JO | 2001-355369 | A | 12/2001 |
| JP | S56-163071 | U | 12/1981 |
| JP | H01-115987 | U | 8/1989 |
| JP | H07-19960 | Y2 | 5/1995 |
| JP | H07-127319 | A | 5/1995 |
| JP | H10-152075 | A | 6/1998 |
| JP | 2001-063632 | A | 3/2001 |
| JP | 2005-153808 | A | 6/2005 |
| JP | 2005-297832 | A | 10/2005 |
| JP | 2007-001399 | A | 1/2007 |
| JP | 2007-062488 | A | 3/2007 |
| JP | 2007-290604 | A | 11/2007 |
| JP | 2013-096079 | A | 5/2013 |

OTHER PUBLICATIONS

Partial Translation of Jun. 21, 2016 Office Action issued in Japanese Patent Application No. 2014-014675.

* cited by examiner

HOOD HINGE STRUCTURE

BACKGROUND OF THE INVENTION

1. Field of the Invention

The invention relates to a hood hinge structure and a hood hinge.

2. Description of Related Art

Japanese Examined Utility Model Application Publication No. 7-19960 (JP 07-19960 Y) describes a hood hinge structure (hinge support structure) that includes a hood hinge arm having an L-shaped cross-section. The hood hinge arm having the L-shaped cross-section has a rising wall portion that extends in a direction orthogonal to a hood, and a flange wall portion that extends in a direction in which the hood extends. The rising wall portion is fixed to the hood. With the hood hinge structure described in JP 07-19960 Y, the rigidity of the hood hinge arm is ensured by having the hood hinge arm be formed with an L-shaped cross-section.

Hood vibration when a vehicle is running can be reduced by increasing the rigidity of the hood hinge arm. The hood hinge structure described in JP 07-19960 Y has room for improvement in terms of reducing hood vibration.

SUMMARY OF THE INVENTION

The invention thus provides a hood hinge structure and a hood hinge capable of reducing hood vibration when a vehicle is running.

A first aspect of the invention relates to a hood hinge structure that includes a hood hinge base and a hood hinge arm. The hood hinge base is fixed to a vehicle body. The hood hinge arm includes a supported portion and a fixed portion. The supported portion is provided at a base end side of the hood hinge arm and is supported by the hood hinge base. The fixed portion is provided at a tip end side of the hood hinge arm and is fixed to a hood. At least a portion of the hood hinge arm from the supported portion to the fixed portion has a laminated structure.

With the hood hinge structure according to the first aspect of the invention, the rigidity of the hood hinge arm is improved by having at least a portion from the supported portion to the fixed portion of the hood hinge arm be a laminated structure. As a result, vibration of a hood supported by the vehicle body via the hood hinge arm and the hood hinge base is able to be reduced.

In the first aspect, the hood hinge arm may be formed of a single sheet. Also, the supported portion and the fixed portion may each have the laminated structure formed of the single sheet that is bent.

According to this hood hinge structure, a hood hinge arm that includes a supported portion and a fixed portion each having a laminated structure obtained by bending a single sheet is able to be obtained. As a result, an increase in the number of parts that make up the hood hinge arm is able to be suppressed.

Also, the hood hinge arm may have an intermediate portion that consists of a non-laminated structure, between the supported portion and the fixed portion.

According to this hood hinge structure, the portion between the supported portion and the fixed portion of the hood hinge arm is not a laminated, structure, so formability of this portion is able to be improved (i.e., the degree of freedom regarding the shape of the portion is able to be improved).

In the first aspect of the invention, laminated portions each having the laminated structure may be arranged spaced apart in a longitudinal direction of the fixed portion, at the fixed portion.

According to this hood hinge structure, the laminated portions are arranged spaced apart in the longitudinal direction of the fixed portion, so vibration transmitted in the longitudinal direction of the fixed portion is able to be effectively damped.

The hood hinge structure according to the first aspect of the invention may also have a vibration absorbing member interposed in at least a portion of the portion having the laminated structure.

According to this hood hinge structure, vibration transmitted through the hood hinge arm is able to be effectively damped by the vibration absorbing member.

Also, the hood hinge structure having the structure described above may also have a spacer having a thickness corresponding to a thickness of the vibration absorbing member. Also, an insertion hole through which a bolt is inserted may be formed in the fixed portion. Further, the spacer may be interposed in the laminated structure provided at a peripheral edge portion of the insertion hole.

According to this hood hinge structure, the vibration absorbing member will not be crushed by the axial force of the bolt because the spacer is interposed in the peripheral edge portion of the fixed portion. As a result, a decrease in the axial force of the bolt is able to be suppressed.

The hood hinge structure according to the first aspect of the invention has the effects of being able to reduce hood vibration when a vehicle is running.

A second aspect of the invention relates to a hood hinge that includes a hood hinge base and a hood hinge arm. The hood hinge arm includes a supported portion and a fixed portion. The supported portion is provided at a first end side in a longitudinal direction of the hood hinge arm and is supported by the hood hinge base. The fixed portion is provided at a second end side in the longitudinal direction. At least a portion of the hood hinge arm has a laminated structure in the longitudinal direction.

The hood hinge according to the second aspect of the invention has effects similar to those of the hood hinge structure according to the first aspect of the invention.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
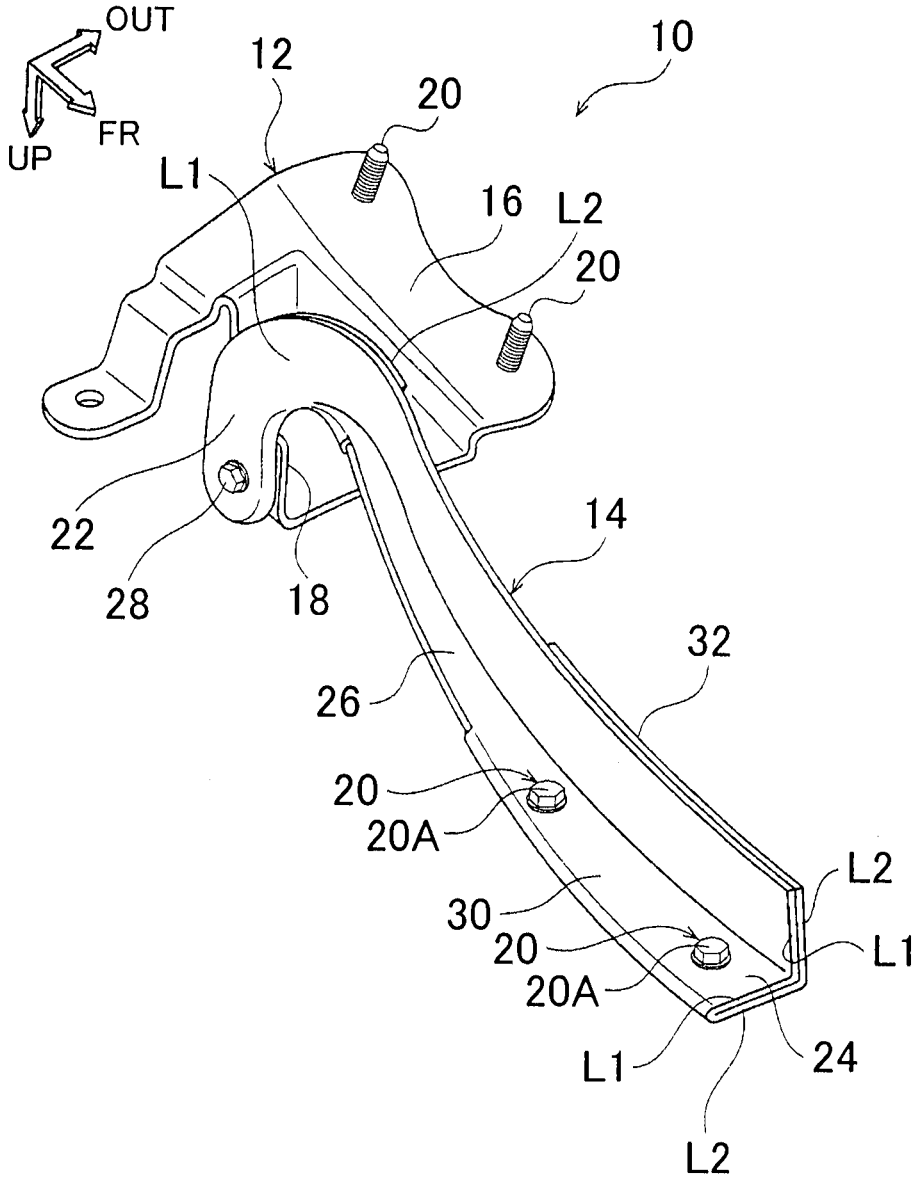
FIG. 1 is a perspective view of a hood hinge according to one example embodiment of the invention.

A hood hinge structure according to one example embodiment of the invention will now be described with reference to FIGS. 1 and 2. In the drawings, arrow FR indicates a front side in a longitudinal direction of a vehicle, arrow OUT indicates an outside in a vehicle width direction, and arrow UP indicates an upper side in a vehicle vertical direction. Also, in the described below, when simply referring to the directions of front and rear, and upper and lower, these are to be understood as front and rear in the vehicle longitudinal (front-rear) direction, and upper and lower in the vehicle vertical direction.

As shown in FIG. 1, a hood hinge 10 to which the hood hinge structure according to the example embodiment is applied includes a hood hinge base 12 that is fixed to a vehicle body, and a hood hinge arm 14. The hood hinge arm 14 includes a supported portion 22 that is provided at a base end side and is supported by the hood hinge base 12, and a fixed portion 24 that is provided at a tip end side and is fixed to a hood. The hood hinge base 12 that is arranged at the vehicle right side and a hood hinge base that is arranged at the vehicle left side are symmetrical in the vehicle width direction, so only the hood hinge base 12 that is arranged at the vehicle right side will be described below. A description of the hood hinge that is arranged at the vehicle left side will be omitted.

The hood hinge base 12 is formed by press-forming a steel sheet, for example. This hood hinge base 12 includes a fixed portion 16 that is fixed to the vehicle body, and a supporting portion 18 that supports a hood hinge arm 14. Also, the hood hinge base 12 is fixed to the vehicle body by bolts 20 that are inserted through the fixed portion 16 being screwed into weld nuts or the like that are fixed to the vehicle body.

The hood hinge arm 14 is formed by, for example, press-forming, e.g., bending, a single steel sheet that has been cut into a predetermined shape. This hood hinge arm 14 includes the supported portion 22 and the fixed portion 24, as well as an intermediate portion 26 that connects the supported portion 22 and the fixed portion 24 together. A pin 28 is inserted through the supported portion 22. The hood hinge arm 14 is pivotally supported on the hood hinge base 12 by having one end of this pin 28 be fixed to the supporting portion 18 of the hood hinge base 12. Also, the intermediate portion 26 and the fixed portion 24 have a base wall portion 30 that extends along a hood, not shown, and a side wall portion 32 that extends bent towards the vehicle lower side from a vehicle width direction outside end of the base wall portion 30. A generally L-shaped cross-section is formed by the base wall portion 30 and the side wall portion 32 when viewed from the front of the vehicle.

In this example embodiment, the supported portion 22 and the fixed portion 24 of the hood hinge arm 14 have laminated structures. More specifically, the supported portion 22 has a double layered structure formed by a portion of the steel sheet being folded over, and then this portion of the steel sheet being made to contact another portion of the steel sheet in the plate thickness direction. An inside portion of the supported portion 22 in the vehicle width direction will be referred to as a first layer forming portion L1. Also, an outside portion of the supported portion 22 in the vehicle width direction will be referred to as a second layer forming portion L2. The second layer forming portion L2 closely contacts, in the plate thickness direction, an outside of the first layer forming portion L1 in the vehicle width direction.

Figure 2:
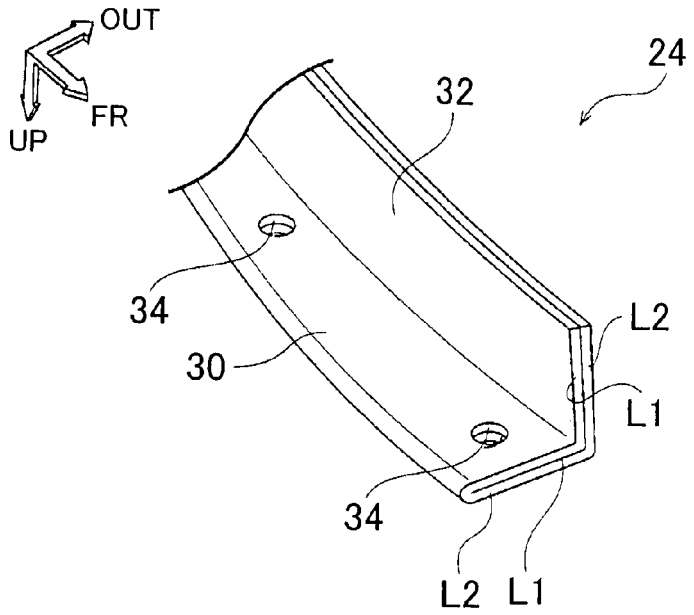
FIG. 2 is an enlarged perspective view of a fixed portion of a hood hinge arm according to the example embodiment.

As shown in FIG. 2, the fixed portion 24 also has a double layered structure formed by a portion of the steel sheet being folded over, and then this portion of the steel sheet being made to contact another portion of the steel sheet in the plate thickness direction. Also, two insertion holes 34 into which the bolts 20 are inserted are formed in the base wall portion 30 having the double layered structure, and these two insertion holes 34 are arranged a predetermined distance apart in the longitudinal direction of the fixed portion 24. Then the fixed portion 24 is fixed to the hood by the bolts 20 (see FIG. 1) that have been inserted through these insertion holes 34 being screwed into weld nuts or the like that are joined to the hood. A lower portion of the base wall portion 30 of the fixed portion 24 in the vehicle vertical direction will be referred to as the first layer forming portion L1. Also, an upper portion of the base wall portion 30 of the fixed portion 24 in the vehicle vertical direction will be referred to as the second layer forming portion L2. The second layer forming portion L2 closely contacts, in the plate thickness direction, an upper side of the first layer forming portion L1 in the vehicle vertical direction. Similarly, an inside portion of the side wall portion 32 of the fixed portion 24 in the vehicle width direction will be referred to as the first layer forming portion L1. Also, an outside portion of the side wall portion 32 of the fixed portion 24 will be referred to as the second layer forming portion L2. The second layer forming portion L2 closely contacts, in the thickness direction, an outside of the first layer forming portion L1 in the vehicle width direction.

Next, the operation and effects of this example embodiment will be described.

As shown in FIG. 1, with the hood hinge 10 to which the hood hinge structure of this example embodiment is applied, the rigidity of the hood hinge arm 14 is able to be improved by having the supported portion 22 and the fixed portion 24 of the hood hinge arm 14 be laminated structures. As a result, vibration of the hood that is supported by the vehicle body via the hood hinge arm 14 and the hood hinge base 12 is able to be reduced.

Also, in this example embodiment, the hood hinge arm 14 that has the supported portion 22 and the fixed portion 24 that have laminated structures is able to be obtained by a single steel sheet being bent. As a result, an increase in the number of parts that form the hood hinge arm 14 is able to be suppressed. Moreover, in this example embodiment, formability when the intermediate portion 26 is press-formed is able to be improved (i.e., the degree of freedom regarding the shape of the intermediate portion 26 is able to be improved) by not having the intermediate portion 26 that is between the supported portion 22 and the fixed portion 24 of the hood hinge arm 14 be a laminated structure.

In this example embodiment, an example in which the hood hinge arm 14 having the supported portion 22 and the fixed portion 24 that are laminated structures is formed by a single steel sheet being bent is described, but the invention is not limited to this. For example, a hood hinge arm that has a supported portion and a fixed portion that are laminated structures may be formed by overlapping a plurality of sheets of a predetermined thickness and joining them together.

Also, in this example embodiment, an example in which the intermediate portion 26 that is between the supported portion 22 and the fixed portion 24 of the hood hinge arm 14 is not a laminated structure is described, but the invention is not limited to this. For example, the entire hood hinge arm may be a laminated structure.

Figure 3:
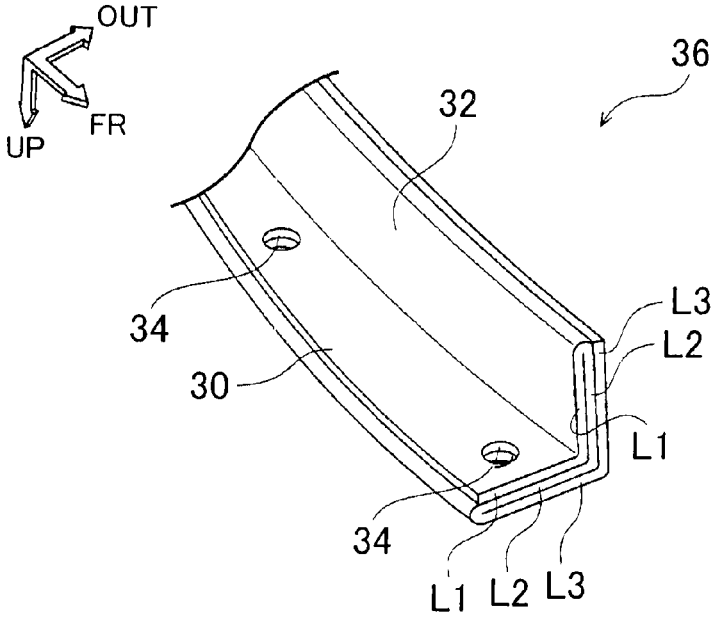
FIG. 3 is an enlarged perspective view of a fixed portion of a hood hinge arm according to a first modified example.

Furthermore, in this example embodiment, an example in which the supported portion 22 and the fixed portion 24 of the hood hinge arm 14 are double layered laminated structures is described, but the invention is not limited to this. For example, a fixed portion 36 of the hood hinge arm 14 may also be a three layered laminated structure, as in a first modified example shown in FIG. 3. In this way, the number of layers of each portion of the hood hinge arm 14 may be set appropriately taking the rigidity and the like of the hood hinge arm 14 into account. An upper portion of the base wall portion 30 of the fixed portion 36 in the vehicle vertical direction will be referred to as a third layer forming portion L3. The third layer forming portion L3 closely contacts, in the plate thickness direction, an upper side of the second layer forming portion L2 in the vehicle vertical direction. Also, an outside portion of the side wall portion 32 of the fixed portion 36 in the vehicle width direction will also be referred to as the third layer forming portion L3. The third layer forming portion L3 closely contacts, in the plate thickness direction, an outside of the second layer forming portion L2 in the vehicle width direction.

Next, fixed portions 38 and 40 according to modified examples of the example embodiment described above will be described with reference to FIGS. 4 to 6. Portions having the same function as the fixed portion 24 of the foregoing example embodiment and the fixed portion 36 according to the first modified example will be denoted by the same references characters as those used in the example embodiment and the like described above, and descriptions of these portions will be omitted.

Figure 4:
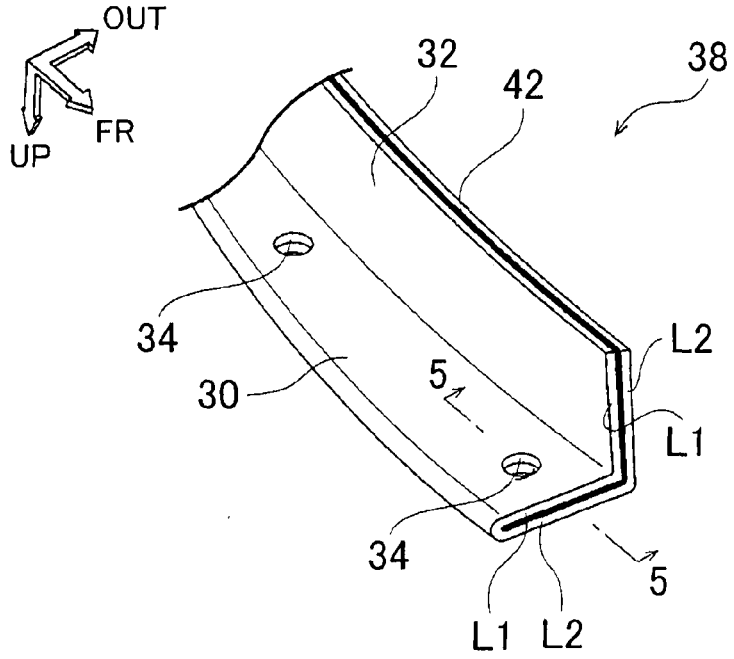
FIG. 4 is an enlarged perspective view of a fixed portion of a hood hinge arm according to a second modified example.

As shown in FIG. 4, the fixed portion 38 according to a second modified example is characteristic in that a vibration absorbing member 42 formed using elastic material such as a rubber sheet or a urethane sheet is interposed between the first layer forming portion L1 and the second, layer forming portion L2 of the base wall portion 30 and the side wall portion 32. The fixed portion 38 is formed by the steel sheet being bent after the vibration absorbing member 42 has been affixed to a predetermined portion of the steel sheet.

Figure 5:
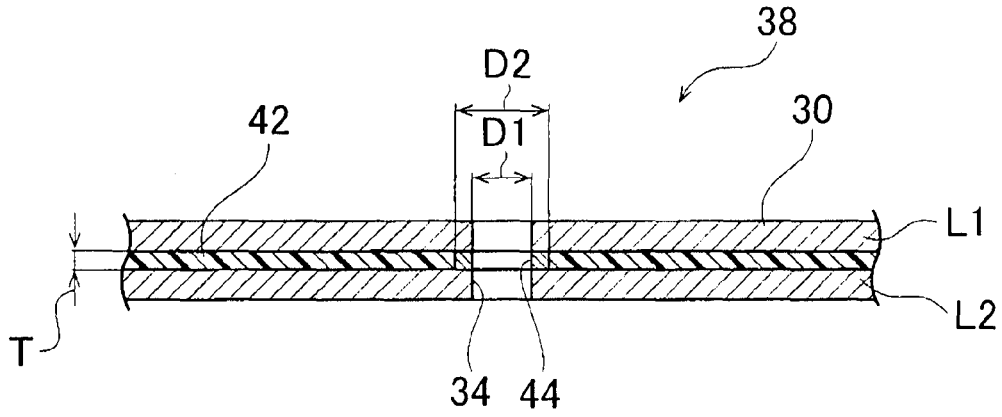
FIG. 5 is an enlarged sectional view of a cross-section of the fixed portion of the hood hinge arm cut along line 5-5 in FIG. 4.

Also, as shown in FIG. 5, in this example embodiment, a spacer 44 having a thickness T that corresponds to a thickness of the vibration absorbing member 42 is interposed in a peripheral edge portion of the insertion holes 34. The thickness of the vibration absorbing member 42 may be equal to the thickness T. More specifically, the spacer 44 is formed in a ring shape with an inside diameter D1 that is substantially the same as the inside diameter of the insertion holes 34, and an outside diameter D2 that is substantially the same as the outside diameter of a head portion 20A of the bolts 20 (see FIG. 1). This spacer 44 is sandwiched between the first layer forming portion L1 and the second layer forming portion L2 of the base wall portion 30, in a state arranged on the same axis as the insertion holes 34.

Figure 6:
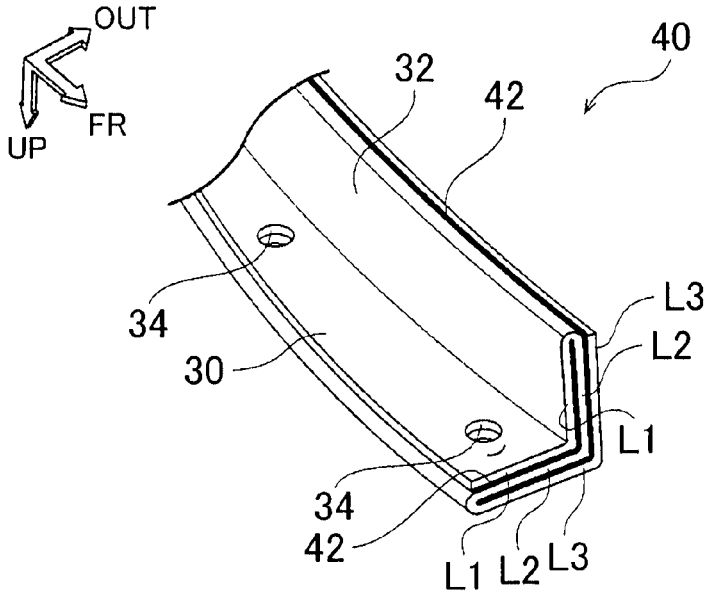
FIG. 6 is an enlarged perspective view of a fixed portion of a hood hinge arm according to a third modified example.

As shown in FIG. 6, with the fixed portion 40 according to a third modified example, the vibration absorbing member 42 is interposed between the first layer forming portion L1 and the second layer forming portion L2 of the base wall portion 30 and the side wall portion 32, as well as between the second layer forming portion L2 and the third layer forming portion L3 of the base wall portion 30 and the side wall portion 32. With the fixed portion 40 according to this modified example, the spacer 44 is sandwiched between the first layer forming portion L1 and the second layer forming portion L2 of the base wall portion 30, as well as between the second layer forming portion L2 and the third layer forming portion L3 of the base wall portion 30, in a state arranged on the same axis as the insertion holes 34.

With the hood hinge arms 14 having the fixed portions 38 and 40 according to second and third modified examples described above, vibration that is transmitted through the hood hinge arm 14 is able to be effectively damped by the vibration absorbing member 42.

Next, fixed portions 46 and 48 according to modified examples of the example embodiment described above will be described with reference to FIGS. 7 and 8. Portions having the same function as those of the fixed portions 24 and 36 of the example embodiment and the like described above will be denoted by the same reference characters that are used in the example embodiment and the like described above, and descriptions of these portions will be omitted.

Figure 7:
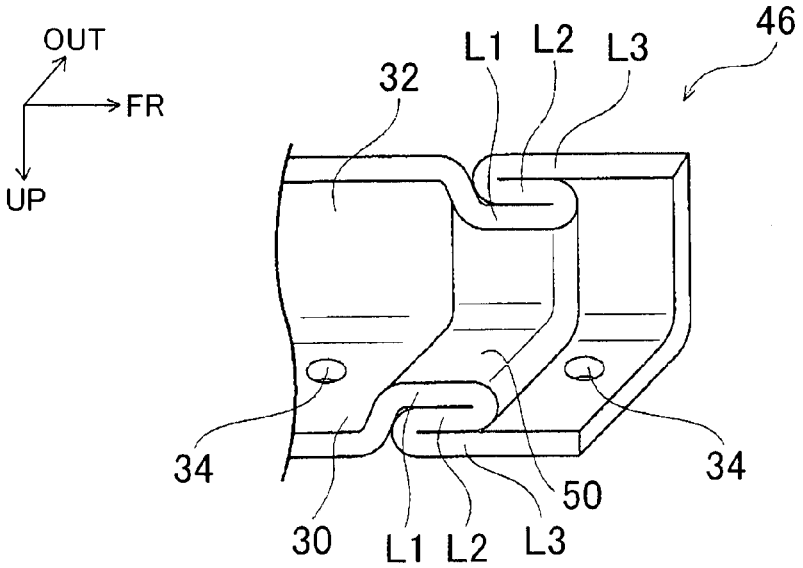
FIG. 7 is an enlarged perspective view of a fixed portion of a hood hinge arm according to a fourth modified example.

As shown in FIG. 7, the fixed portion 46 according to a fourth modified example is characteristic in that a portion between the two insertion holes 34 in the fixed portion 46 is a laminated portion 50 that is a laminated structure. This laminated portion 50 is formed by the portion between the two insertion holes 34 in the fixed portion 46 being bent in a bellows shape in the longitudinal direction of the fixed portion.

Figure 8:
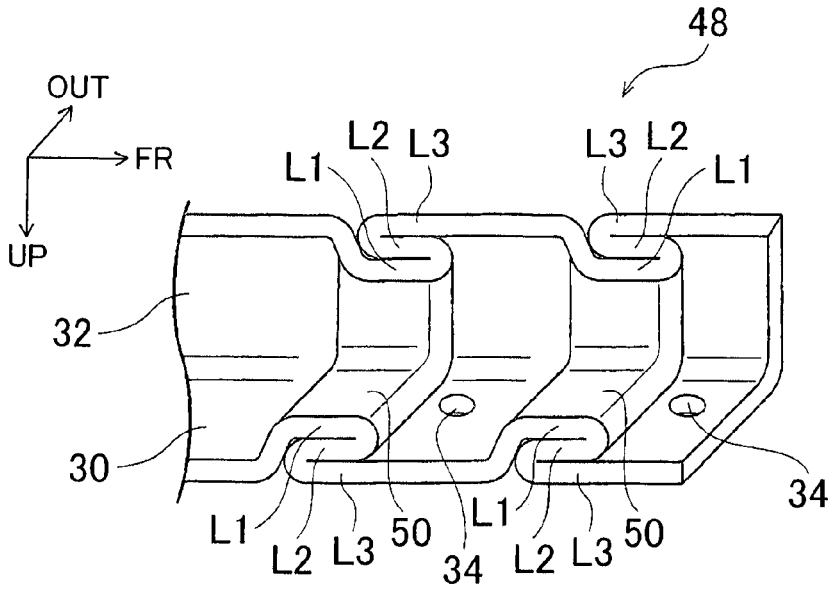
FIG. 8 is an enlarged perspective view of a fixed portion of a hood hinge arm according to a fifth modified example.

As shown in FIG. 8, the fixed portion 48 according to a fifth modified example is characteristic in that a portion between the two insertion holes 34 in the fixed portion 48, as well as a portion farther toward the rear than the insertion holes 34 on the vehicle rearward side is the laminated portion 50 that is a laminated structure. That is, the two laminated portions 50 are arranged a predetermined distance apart from each other in the longitudinal direction of the fixed portion 48.

With the fixed portion 46 according to the fourth modified example described above, having the laminated portion 50 of the structure described above enables vibration transmitted in the longitudinal direction of the fixed portion 46 to be effectively damped. Moreover, a structure in which two of the laminated portions 50 are arranged a predetermined distance apart from each other in the longitudinal direction of the fixed portion 48, such as that of the fixed portion 48 in the fifth modified example, enables vibration transmitted in the longitudinal direction of the fixed portion 48 to be even more efficiently damped.

Figure 9:
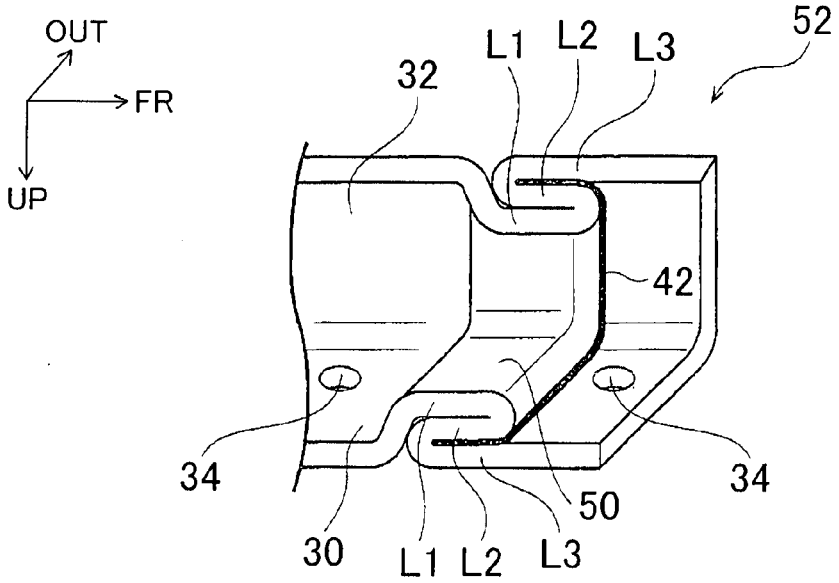
FIG. 9 is an enlarged perspective view of a fixed portion of a hood hinge arm according to a sixth modified example.
Figure 10:
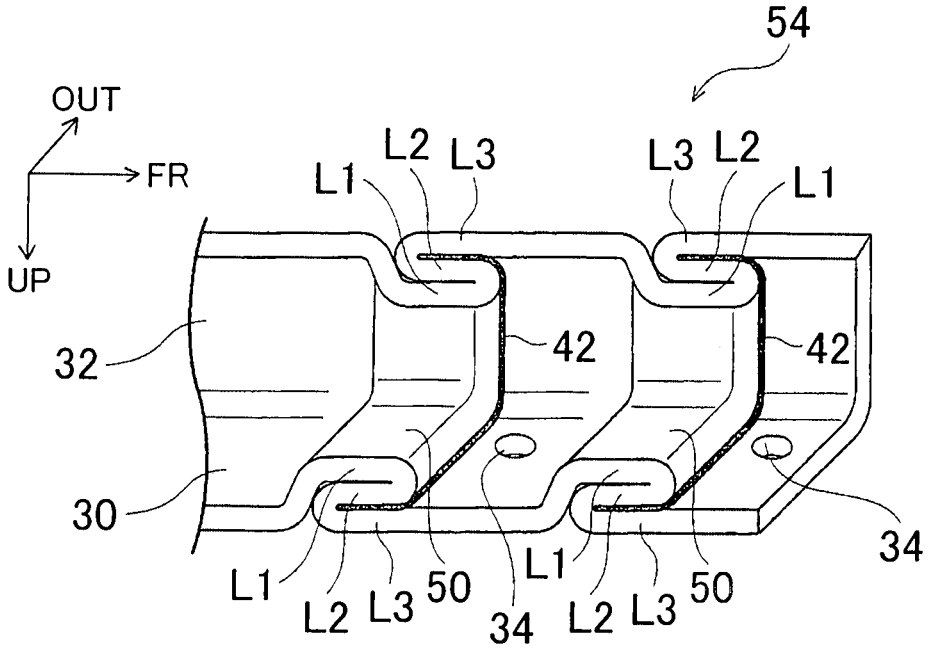
FIG. 10 is an enlarged perspective view of a fixed portion of a hood hinge arm according to a seventh modified example.

Also, interposing the vibration absorbing member 42 between the second layer forming portion L2 and the third layer forming portion L3 of the laminated portion 50, as it is with fixed portions 52 and 54 according to sixth and seventh modified examples shown in FIGS. 9 and 10, makes it possible to even further increase the damping capacity with respect to vibration transmitted in the longitudinal direction of the fixed portions 52 and 54.

While the invention has been described with reference to the example embodiment and modified examples thereof, the invention is not limited to the foregoing description, but may be embodied with various other modifications without departing from the scope of the invention.

What is claimed is:

1. A hood hinge structure comprising:

a hood hinge base that is fixed to a vehicle body; and a hood hinge arm that includes a supported portion and a fixed portion, the supported portion being provided at a base end side of the hood hinge arm and being pivotally supported by the hood hinge base, and the fixed portion being provided at a tip end side of the hood hinge arm and being fixed to a hood, wherein at least a portion of the hood hinge arm from the supported portion to the fixed portion has a laminated structure, the hood hinge arm is formed of a single sheet, the supported portion and the fixed portion each have the laminated structure formed of the single sheet that is bent, the laminated structure of the fixed portion is bent to have a base wall portion and a side wall portion, the base wall portion extends along the hood and has insertion holes into which bolts are inserted, and the base wall portion is fixed to the hood with the bolts.

2. The hood hinge structure according to claim 1, wherein the hood hinge arm includes an intermediate portion that consists of a non-laminated structure, between the supported portion and the fixed portion.

3. The hood hinge structure according to claim 2, wherein the intermediate portion is directly connected to the supported portion and the fixed portion.

4. The hood hinge structure according to claim 1, wherein laminated portions each having the laminated structure are arranged spaced apart in a longitudinal direction of the fixed portion, at the fixed portion.

5. The hood hinge structure according to claim 4, wherein the laminated portions are folded back in the longitudinal direction of the fixed portion.

6. The hood hinge structure according to claim 1, further comprising:

a vibration absorbing member interposed between layers in at least a portion of the portion forming the laminated structure.

7. The hood hinge structure according to claim 6, further comprising:

a spacer having a thickness corresponding to a thickness of the vibration absorbing member, wherein the spacer is interposed between the layers in the laminated structure at a peripheral edge portion of each insertion hole.

* * * * *